US009339708B2

(12) United States Patent
Gonzalez

(10) Patent No.: US 9,339,708 B2
(45) **Date of Patent: *May 17, 2016**

(54) THROWING GAME SYSTEM

(71) Applicant: Robert J. Gonzalez, Bethel Park, PA (US)

(72) Inventor: Robert J. Gonzalez, Bethel Park, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/943,531

(22) Filed: Nov. 17, 2015

(65) Prior Publication Data

US 2016/0067573 A1 Mar. 10, 2016

Related U.S. Application Data

(60) Continuation of application No. 14/613,655, filed on Feb. 4, 2015, which is a division of application No. 13/611,903, filed on Sep. 12, 2012, now Pat. No. 9,005,055.

(51) Int. Cl.
*A63B 63/00* (2006.01)
*A63B 67/06* (2006.01)

(52) U.S. Cl.
CPC ..... *A63B 67/06* (2013.01); *A63B 63/007* (2013.01); *A63B 2067/061* (2013.01)

(58) Field of Classification Search
CPC ..... A63B 67/06; A63H 33/18
USPC ..... 473/470, 476, 494, 495, 590, 454, 459, 473/490–493; 446/46, 47, 38, 39, 48; 273/343, 350, 364, 365, 398, 400
See application file for complete search history.

(56) References Cited

U.S. PATENT DOCUMENTS

| | | | | |
|---|---|---|---|---|
| 100,466 | A | 3/1870 | Taylor | |
| 152,101 | A | 6/1874 | Glahn | |
| 341,463 | A | 5/1886 | Eason | |
| 1,135,451 | A | 4/1915 | Heath | |
| 1,483,488 | A * | 2/1924 | Hans Skreberg | A63F 9/0204 273/400 |
| 1,592,005 | A | 7/1926 | Rovane | |
| 2,432,774 | A | 12/1947 | Lefustec | |
| 3,082,572 | A | 3/1963 | Knox | |
| 3,182,422 | A * | 5/1965 | Ryan | A63H 27/14 273/DIG. 17 |
| 3,220,142 | A | 11/1965 | Butterfield | |

(Continued)

OTHER PUBLICATIONS

Webpage download, amstyrenics, 2011, web.archive.org/web/20110501170229/http://www.amstyrenics.com/products/Pages/gpps.aspx, 2 pages.

(Continued)

*Primary Examiner* — Gene Kim
*Assistant Examiner* — Michael Chambers
(74) *Attorney, Agent, or Firm* — Metz Lewis Brodman Must O'Keefe LLC

(57) ABSTRACT

A throwing disc, goal apparatus, and game are provided. A disc includes a central hub with blades projecting equiangularly from the hub. The blades are circumscribed by and joined to an outer perimeter ring that aids in throwing. The blades of the disc act as airfoils and impart unique flight characteristics to the disc. A goalpost is comprised of two vertical sections, joined by a horizontal cross-bar located above the midline of the vertical sections, and supported by a rectangular frame oriented perpendicularly to the vertical sections. A scoring pad is included. The game is played by tossing the disc and attempting to pass the disc while in flight between the vertical posts and above the horizontal cross-bar of the goalpost, and landing the disc on the scoring pad.

18 Claims, 2 Drawing Sheets

(56) References Cited

U.S. PATENT DOCUMENTS

| | | | | |
|---|---|---|---|---|
| 3,473,256 | A | 10/1969 | Tyler | |
| 3,570,467 | A | 3/1971 | Belokin | |
| 3,580,578 | A * | 5/1971 | McCarthy | A63B 67/002 273/401 |
| 3,742,643 | A * | 7/1973 | Keith | A63H 33/18 446/46 |
| 3,895,801 | A | 7/1975 | Baird | |
| 3,908,992 | A | 9/1975 | Cunningham et al. | |
| 3,959,917 | A | 6/1976 | Dawson | |
| 4,045,029 | A | 8/1977 | Katzmark | |
| 4,185,826 | A | 1/1980 | Ueng | |
| D257,364 | S | 10/1980 | Molenaar | |
| 4,295,648 | A | 10/1981 | Stromback | |
| 4,357,019 | A | 11/1982 | Wouters | |
| 4,373,734 | A * | 2/1983 | Frank | A63B 67/00 273/401 |
| 4,415,150 | A | 11/1983 | Iezza | |
| 4,461,485 | A | 7/1984 | Horvath et al. | |
| 4,781,642 | A | 11/1988 | Stanzel | |
| 5,030,157 | A | 7/1991 | Silverglate | |
| 5,080,624 | A | 1/1992 | Brinker | |
| 5,098,109 | A | 3/1992 | Wayne | |
| 5,181,725 | A | 1/1993 | Leras et al. | |
| 5,333,880 | A | 8/1994 | Allbright | |
| 5,533,735 | A | 7/1996 | Denney | |
| 5,536,195 | A | 7/1996 | Stamos | |
| 5,800,237 | A | 9/1998 | Cummings | |
| 5,827,137 | A | 10/1998 | Ishino | |
| 5,906,529 | A | 5/1999 | Spais | |
| 5,941,529 | A * | 8/1999 | Kinsey | A63B 63/00 273/401 |
| 6,659,466 | B2 | 12/2003 | Searles et al. | |
| 6,808,175 | B1 | 10/2004 | Gleeson | |
| 6,921,313 | B2 | 7/2005 | Yu | |
| 7,429,223 | B2 | 9/2008 | Dovrat et al. | |
| D609,280 | S | 2/2010 | Lessard | |
| 8,016,290 | B1 | 9/2011 | Rhodes | |
| 8,827,845 | B1 * | 9/2014 | Griffin | A63B 3/00 273/400 |
| 9,005,055 | B2 * | 4/2015 | Gonzalez | A63B 67/06 446/46 |
| 2002/0098768 | A1 | 7/2002 | Kuo | |
| 2002/0125644 | A1 * | 9/2002 | Knudson | A63B 63/00 273/398 |
| 2003/0022587 | A1 | 1/2003 | Calco | |
| 2004/0132561 | A1 | 7/2004 | McClung et al. | |
| 2005/0062231 | A1 | 3/2005 | Olster | |
| 2005/0082762 | A1 | 4/2005 | David | |
| 2005/0134001 | A1 * | 6/2005 | Rowan | A63B 63/00 273/401 |
| 2005/0269784 | A1 | 12/2005 | Peters | |
| 2006/0116226 | A1 | 6/2006 | Padilla | |
| 2006/0199658 | A1 | 9/2006 | Leonard | |
| 2006/0202426 | A1 | 9/2006 | Tennett | |
| 2007/0197318 | A1 | 8/2007 | Serrano | |
| 2008/0153381 | A1 | 6/2008 | Schenk et al. | |
| 2008/0224409 | A1 | 9/2008 | Marshall et al. | |
| 2009/0017946 | A1 * | 1/2009 | Nally | A63B 61/02 473/492 |
| 2009/0278317 | A1 | 11/2009 | Lima | |
| 2011/0294611 | A1 | 12/2011 | Roman | |
| 2014/0070493 | A1 | 3/2014 | Gonzalez | |
| 2014/0243119 | A1 | 8/2014 | Whalen | |

OTHER PUBLICATIONS

Webpage download, Shapeupshop2013, 2013, web.archive.org/web/20130819920608/http://www.shapeupshop.com/games/bean_bag/beanbag-lotto.html, e pages.

Webpage download, Aaainflatables2009, 2009, eb.archive.org/web/20090809163835/http:/aaainflatables.co.uk/garden_games.html, 1 page.

* cited by examiner

THROWING GAME SYSTEM

RELATED APPLICATIONS

The present application is a continuation of application U.S. Ser. No. 14/613,655, filed on Feb. 4, 2015, which is a divisional of U.S. Ser. No. 13/611,903, filed on Sep. 12, 2012, which matured into U.S. Pat. No. 9,005,055 on Apr. 14, 2015, the contents of which are incorporated by reference in their entireties as if fully set forth herein.

FIELD OF THE INVENTION

The present invention relates generally to a throwing game. More particularly, the present application involves a unique flying disc used in combination with a goalpost and scoring pad to play a throwing game.

BACKGROUND

There is a long history of children and adults using flying discs for recreational use. From a basic throw and catch game using a FRISBEE to more advanced games where points are scored, the prior art discloses many examples of different approaches to flying disc games. Examples of disc games in the prior art can be divided broadly into two categories: creation of unique flying discs and creation of unique flying games utilizing a traditional FRISBEE flying disc.

Notwithstanding the field of prior art, there remains opportunities to experiment and develop improvements to both the flying disc and the method of gameplay with that disc. This is precisely what has been undertaken here, and the disclosed flying disc, goalpost, and scoring pad present a unique disc game suitable for outdoor or indoor play.

SUMMARY OF THE INVENTION

In accordance with an illustrated preferred embodiment of the present invention, a flying disc possessing radial blades positioned uniformly about a central hub, fixed to both the central hub and a peripheral ring are provided. The radial blades may be positioned at an angle relative to the hub and periphery optimized to allow the blades to act as airfoils, providing loft. The radial blades provide the disc with flight characteristics markedly different from the traditional FRISBEE, and such flying characteristics are uniquely suited for the game disclosed here. The peripheral ring of the disc may be perforated with circular, equally spaced holes which both allow air to pass through the periphery and decrease weight. Although described as being circular, equally spaced holes, the apertures of the peripheral ring may be variously shaped such as oval, triangular, slotted, or irregular and they may all be of the same shape or some or all can be of different shapes. Further, although described as being equally spaced, the apertures of the peripheral ring may be unequally spaced in accordance with various exemplary embodiments of the flying disc. The peripheral ring enables the player to throw and catch the disc effectively.

The construction of the disc allows a player to throw the disc away from the player and into the air. Once the disc passes its apex, the airfoil effect of the radial blades impart lift forces to the disk, which causes the disc to stall in flight and descend to the ground near the point of its apex. Instead of the even, shallow, parabolic flight path typical of a FRISBEE disc (a solid circular plastic disc), the flying disc disclosed here provides a flight path characterized by a steady, linear ascent to apex, at which time the disc falls to the ground nearly vertically from its apex, creating an asymmetrical flight path.

The invention also includes a goal apparatus. The goal apparatus may be composed of PVC plastic pipe or similar, and consists of two sections oriented vertically, connected above the midpoint of the vertical sections by a horizontal cross-bar. Connected perpendicularly to the bottom of the vertical sections is a rectangular base. The base connects to the vertical sections at the midpoints of the length of the rectangle. Contained within the rectangular base is a scoring pad, which may be fabricated from nylon mesh or similar material. The scoring pad is divided into scoring regions.

The game is played by players standing a distance from the goal apparatus, and tossing the disc towards the goal apparatus by imparting horizontal spin to the disc. Scoring requires directing the flying disc through the vertical sections and above the horizontal cross-bar section. Additional points are awarded by landing the disc on the scoring pad. The unique flight characteristics of the disc make this game possible. The flight path of a traditional FRISBEE does not permit a player to pass the disc both over the goalpost and land it on the scoring pad. The first player to reach a predetermined number of points wins.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which:

FIG. 1(*a*) is a cross-sectional view of the disc of FIG. 1 taken from inside of the disc between the hub and the outer ring looking towards the inside of the outer ring.

FIG. 1(*b*) is a side cut away view of the disc of FIG. 1.

FIG. 2(*a*) is a side view of the goalpost of FIG. 2.

Figure 1A:
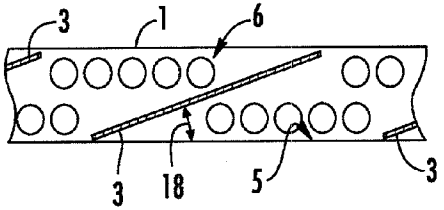
FIG. 1 shows a plan view of the flying disc constructed with the preferred embodiment of the present invention.
Figure 1B:
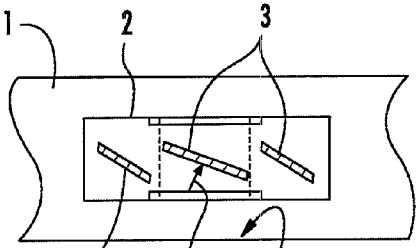

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

What is generally disclosed is a flying disc and goal apparatus that enables a player to play a unique flying disc game. The flying disc is composed of two coaxial rings, a larger outer ring 1 and an inner ring 2. Outer ring 1 and inner ring 2 are connected by fixed blades 3 that act as airfoils and impart loft to the disc. The disc may be fabricated from molded plastic, although other materials, such as balsa wood, could be used.

Figure 3:
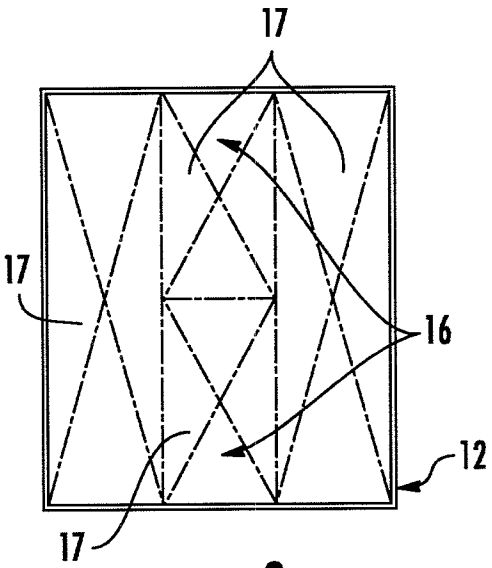
FIG. 3 shows a plan view of the scoring pad and rectangular base.

The goal apparatus may be composed of PVC plastic or similar materials. The goal apparatus consists of two vertically oriented sections 10, connected above the midpoint of the vertical sections by a horizontal cross-bar 11. Connected perpendicularly to the bottom of the vertical sections is a rectangular base 12. The base connects to the vertical sections at the midpoints 13 of the length of the rectangular base 12. Support is provided by strings 14 attached to vertical sections 10. Support arms 15 provide additional support and stabilization to the vertical sections. Contained within the rectangular base 12 is a scoring pad 16, which may be fabricated from nylon mesh or similar material. The scoring pad 16 is divided into zones 17, only a few of which are labeled in FIG. 3, that disclose different point awards based on where the disc lands. In FIG. 3, four scoring regions or zones 17 are shown, a left zone 17, a right zone 17, and two middle zones 17. Individually, each one of the two middle scoring zones 17 are smaller than the left and right scoring zones 17 and are arranged so as to be even in size with one another.

Players take turns throwing the disc between the vertical goal posts 10 and above the horizontal cross-bar 11, attempting to land the disc on the scoring pad 16 for increased points. The first player to score a predetermined number of points is the winner.

Figure 1:
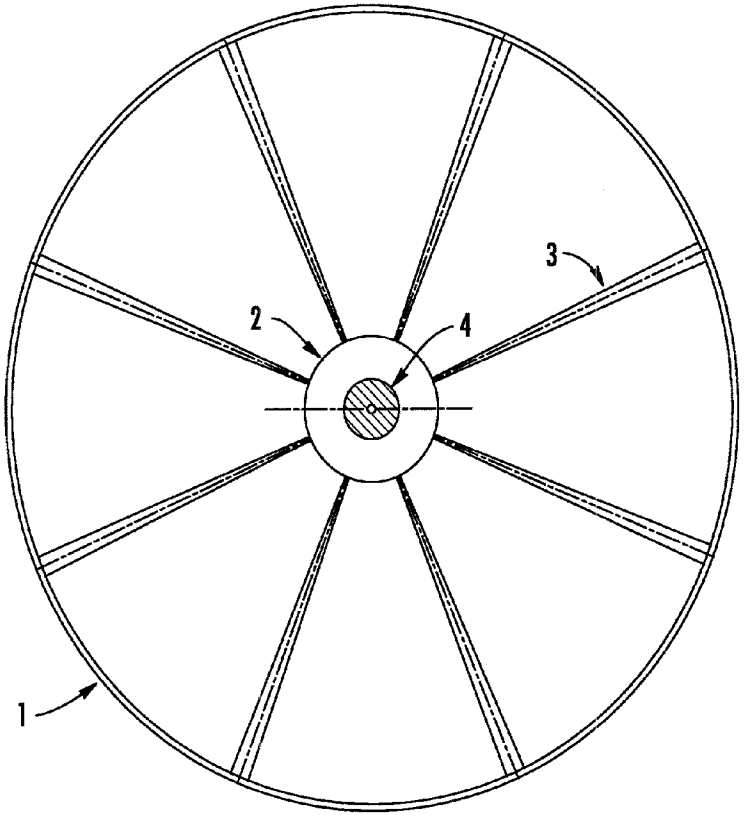

FIGS. 1, 1(*a*) and 1(*b*) show the disc in a preferred embodiment, where the overall symmetry and shape of the ring is depicted. The central hub of the disc 2 consists of a two-inch diameter cylinder. A ¾ inch hole 4 is cut into the center of the cylinder and may be completely or partially filled or covered with a piece of transparent plastic so that one may look through the hole 4 to see a scoring zone 17 or other area below the disc onto which the disc or the center of the central hub 2 rests. A preferred embodiment of the blades 3 may be eight 4.5 inch blades (length) situated every 45 degrees around the hub, bearing a seventeen degree angle 18 from horizontal 5. In accordance with other exemplary embodiments the angle 18 may be from five degrees to forty five degrees, or up to sixty degrees from horizontal 5. A preferred embodiment of the outer ring 1 is eleven inches in diameter and 1.25 inches in height. The peripheral ring 1 is oriented coaxially to the inner ring 2. The blades 3 connect to the outer ring 1 and inner ring 2. The peripheral ring 1 is perforated with small, evenly sized and spaced round holes 6.

The disc depicted in the drawings is a right handed disc for being thrown by the right hand of a user. The disc can be rearranged so that it is configured as a left handed disc for use in being thrown by the left hand of the user. In this regard, the tilt of the blades 3 is reversed. For example, the angle 18 may instead of being seventeen degrees, may be one hundred and sixty three degrees to effect reorientation of the blades 3 for a left handed disc.

Figure 2A:
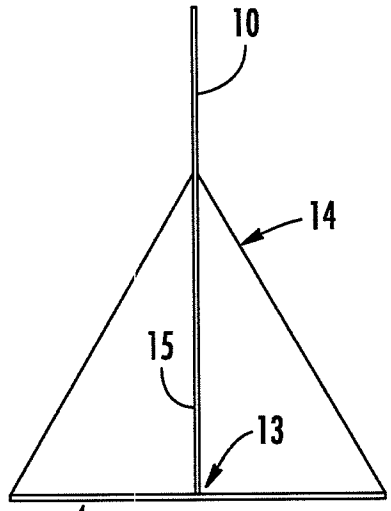
FIG. 2 shows a front view of the goalpost with the preferred embodiment of the present invention, including the rectangular support means affixed to the vertical sections.
Figure 2:
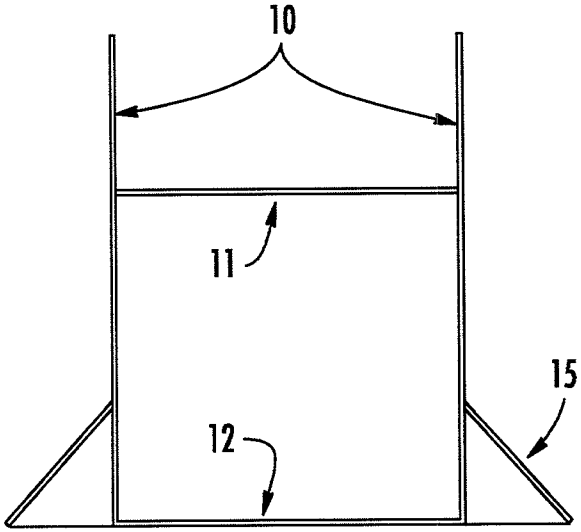

FIG. 2 shows the goal post in its preferred embodiment. In its preferred embodiment it is constructed of plastic pipe ¾ inch in diameter. A preferred embodiment of the vertical sections 10 is twelve-foot long vertical sections 10, joined together by a nine-foot wide horizontal cross-bar section 11 connected eight feet above the bottom of the vertical sections 10. A rectangular base 12, in a preferred embodiment of ten feet by nine feet, attaches perpendicularly to the vertical sections 10 at the midpoint of its length 13 and sits upon the ground. The scoring pad 16 is placed in the rectangular frame 12.

FIG. 3 depicts the scoring pad 16 and goal post base 12 in its preferred embodiment. The scoring pad 16 is placed on the ground and fits to the edges of the rectangular base 12. In a preferred embodiment the scoring pad 16 may be composed of nylon mesh. The scoring pad 16 is divided into different scoring regions 17 with pre-assigned point values.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A throwing game system, comprising:

a flying disc comprising a central hub, wherein the central hub defines a hole at a center of the central hub that extends completely through the central hub, wherein the central hub is made of an opaque material;

a transparent plastic member located at the hole of the central hub that allows viewing completely through the hole, wherein the transparent plastic member closes the hole yet allows viewing completely through the hole due to the transparent nature of the transparent plastic member;

a plurality of fixed blades attached to the central hub projecting outwards from the central hub; and an annular outer ring coaxially oriented with the central hub and having a diameter greater than the central hub to which the fixed blades are permanently attached;

wherein the blades are mounted in such a manner that the flying disc is thrown or launched with an imparted rotational motion resulting in the annular outer ring being the leading aspect in flight such that the annular outer ring is forward of the central hub in a direction of motion upon being initially thrown or launched and wherein the annular outer ring is perforated with evenly spaced and sized round holes; and a bi-planar scoring device having (a) a first planar scoring area defined by a scoring pad divided into a plurality of first scoring zones, at least one of said first scoring zones intended for receiving said flying projectile; and (b) a second planar scoring area defined by at least a plurality of vertical goal sections:

(i) extending perpendicularly from said first planar scoring area;

(ii) dividing said first planar scoring area into at least two first scoring zones; and (iii) divided into a plurality of second scoring zones, at least one of said second scoring zones being intended for receiving said flying projectile.

2. The throwing game system as recited in claim 1, said bi-planar scoring device further comprising a base from which said plurality of vertical goal sections attach and extend perpendicularly away.

3. The throwing game system as recited in claim 2, wherein said vertical goal sections attach to and extend away from a midpoint of said base.

4. The throwing game system as recited in claim 2, wherein said first planar scoring area is located entirely within said base.

5. The throwing game system as recited in claim 1, wherein said flying disc comprises blades permitting an asymmetric flight path through one of said second scoring zones and landing on at least one of said first scoring zones.

6. The throwing game system as recited in claim 1, wherein said first planar scoring area defines a first point value and said second planar scoring area defines a second point value.

7. The throwing game system as recited in claim 1, wherein each of said plurality of first scoring zones defines a different first point value.

8. The throwing game system as recited in claim 1, wherein each of said plurality of second scoring zones defines a different second point value.

9. The throwing game system as recited in claim 1, wherein said second planar scoring area bisects said first planar scoring area.

10. The throwing game system as recited in claim 1, further comprising a cross-bar connecting said vertical goal sections, dividing said second planar scoring area into a plurality of second scoring zones, said second scoring zone above said cross-bar being intended for receiving said flying projectile.

11. The throwing game system as recited in claim 1, wherein said first planar scoring area has a length equal to or less than a height of said vertical goal sections.

12. The throwing game system as recited in claim 1, further comprising at least one support member extending from at least one of said vertical goal sections to the ground.

13. A throwing game system, comprising:

a flying disc comprising a central hub, wherein the central hub defines a hole at a center of the central hub that extends completely through the central hub, wherein the central hub is made of an opaque material;

a transparent plastic member located at the hole of the central hub that allows viewing completely through the hole, wherein the transparent plastic member closes the hole yet allows viewing completely through the hole due to the transparent nature of the transparent plastic member;

a plurality of fixed blades attached to the central hub projecting outwards from the central hub; and an annular outer ring coaxially oriented with the central hub and having a diameter greater than the central hub to which the fixed blades are permanently attached;

wherein the blades are mounted in such a manner that the flying disc is thrown or launched with an imparted rotational motion resulting in the annular outer ring being the leading aspect in flight such that the annular outer ring is forward of the central hub in a direction of motion upon being initially thrown or launched and wherein the annular outer ring is perforated with evenly spaced and sized round holes; and a bi-planar scoring device having (a) a base enclosing a scoring pad defining a first planar scoring area and having a plurality of first scoring zones, at least one of said first scoring zones being intended for receiving said flying projectile;

(b) two vertical goal sections attached to and extending perpendicularly away from said base and defining a second planar scoring area, (c) a horizontal cross-bar connecting said two vertical goal sections spaced apart from said base, dividing said second planar scoring area into at least two second scoring zones, at least one of said second scoring zones being intended for receiving said flying projectile.

14. The throwing game system as recited in claim 13, wherein said second scoring zone above said horizontal cross-bar being intended for receiving said flying projectile.

15. The throwing game system as recited in claim 13, wherein said flying disc comprises a central hub and a plurality of blades extending away from said hub at an angle relative to the horizontal to create an asymmetrical flight path through one of said second scoring zones and landing on at least one of said first scoring zones.

16. The throwing game system as recited in claim 13, wherein said first scoring area defines a first point value and said second scoring area defines a second point value.

17. The throwing game system as recited in claim 13, wherein said base has a length equal to or less than a height of said vertical goal sections.

18. The throwing game system as recited in claim 13, further comprising at least one support member extending from at least one of said vertical goal sections.

* * * * *